US009359735B2

(12) United States Patent
Kanbara et al.

(10) Patent No.: US 9,359,735 B2
(45) Date of Patent: Jun. 7, 2016

(54) AUGER SNOW BLOWER

(71) Applicant: Honda Motor Co., Ltd., Tokyo (JP)

(72) Inventors: Fumiyoshi Kanbara, Wako (JP); Kouhei Matsuzawa, Wako (JP); Atsushi Moroi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 54 days.

(21) Appl. No.: 14/449,285

(22) Filed: Aug. 1, 2014

(65) Prior Publication Data

US 2015/0033592 A1 Feb. 5, 2015

(30) Foreign Application Priority Data

Aug. 2, 2013 (JP) ..... 2013-161547
Aug. 2, 2013 (JP) ..... 2013-161569
Aug. 2, 2013 (JP) ..... 2013-161630

(51) Int. Cl.
*E01H 5/09* (2006.01)
*E01H 5/08* (2006.01)

(52) U.S. Cl.
CPC . *E01H 5/098* (2013.01); *E01H 5/08* (2013.01)

(58) Field of Classification Search
CPC ..... E01H 5/04; E01H 5/0761; E01H 5/098; E01H 5/08
See application file for complete search history.

(56) References Cited

U.S. PATENT DOCUMENTS 6,453,583 B1 * 9/2002 Hanafusa ..... E01H 5/04 37/243
6,539,649 B2 * 4/2003 Sueshige ..... E01H 5/04 192/17 R
6,931,771 B1 * 8/2005 Liebl ..... E01H 5/045 37/248
2005/0241190 A1 * 11/2005 Kettering ..... E01H 5/098 37/258

FOREIGN PATENT DOCUMENTS

JP 08-013439 1/1996
JP 11-061762 3/1999
JP 2004-360379 12/2004
JP 2006-254808 9/2006

OTHER PUBLICATIONS

European Search Report dated Nov. 25, 2014, 7 pages.

* cited by examiner

*Primary Examiner* — Jamie L McGowan
(74) *Attorney, Agent, or Firm* — Rankin, Hill & Clark LLP

(57) ABSTRACT

In an auger snow plow, right and left forward rotating augers and right and left backward rotating augers are disposed on a same axis and aligned in a width direction of an auger housing. A blower housing is disposed at a rear portion of the auger housing and also positioned at a widthwise center of the auger housing. A blower is disposed inside the blower housing. The right and left forward rotating augers are positioned at least in an entire range of a width of the blower housing. The right and left backward rotating augers are separately positioned on both sides of the right and left forward rotating augers and positioned only at a more outer side than the width of the blower housing in the width direction.

3 Claims, 7 Drawing Sheets

AUGER SNOW BLOWER

FIELD OF THE INVENTION

The present invention relates to an improved technology for an auger section of an auger snow blower.

BACKGROUND OF THE INVENTION

Among snow blowers, there is an auger snow blower in which an auger housing is mounted on a front portion of a machine body. The auger housing includes an auger. The auger snow blower collects snow by the auger mounted on the front portion while traveling forward, and blows the collected snow away by a blower via a shooter. This kind of auger snow blower is known, for example, as disclosed in Japanese Patent Application Laid-open Publication (JP-A) No. 2004-360379.

In the auger snow blower disclosed in JP 2004-360379 A, right and left forward rotating augers and right and left backward rotating augers that rotate in a direction reverse to the right and left forward rotating augers are disposed on a same axis and aligned in a width direction inside the auger housing. A blower housing is disposed at a rear portion of the auger housing and also positioned at a center of the width direction of the auger housing. The blower housing includes a blower inside thereof.

The right and left forward rotating augers and the right and left backward rotating augers mutually rotate in the opposite directions. Therefore, an upward reaction force generated at the right and left forward rotating augers can be cancelled by a downward reaction force generated at the right and left backward rotating augers. Accordingly, a lifting phenomenon of the respective augers can be prevented, and stability of snow removal executed by the auger snow blower can be improved.

However, the auger snow blower is required to have not only stability of snow removal but also efficiency of snow removal and there is room for further improvement in efficiency of snow removal.

Further, at the time of snow removal, snow is accumulated in a space between the forward rotating augers and the backward rotating augers, thereby causing the snow to adhere to a forward rotating shaft and a backward rotating shaft. The accumulated snow in the space, therefore, brings disadvantages to improve efficiency of snow removal.

SUMMARY OF THE INVENTION

An object of the present invention is to provide an auger snow blower capable of improving efficiency of snow removal.

According to the present invention, there is provided an auger snow blower in which right and left forward rotating augers configured to rotate from an upper side to a lower front side and right and left backward rotating augers configured to rotate in a direction reverse to the right and left forward rotating augers at the time of snow removal are disposed on a same axis and aligned in a width direction inside an auger housing, and a blower housing is disposed at a rear portion of the auger housing and positioned at a center of the width direction, and further a blower is disposed inside the blower housing, wherein the right and left forward rotating augers are positioned in an entire range of a width of the blower housing, and the right and left backward rotating augers are separately positioned on both sides of the right and left forward rotating augers, and also positioned only at a more outer side than the width of the blower housing in the width direction.

With this arrangement, the snow crushed by the right and left backward rotating augers and the right and left forward rotating augers is collected at the center of the width direction of the auger housing by the right and left forward rotating augers, and further sent to an inlet of the blower housing on the rear side. The right and left forward rotating augers are positioned at least in the entire range of the width of the blower housing. Therefore, the snow collected at the center of the width direction of the auger housing can be efficiently pushed into the entrance of the blower housing by the right and left forward rotating augers that rotate forward from the upper side to the lower front side. On the other hand, the right and left backward rotating augers rotate backward from the upper side to lower back side, thereby sending the crushed snow to the front side. Here, the right and left backward rotating augers are separately positioned on both sides of the right and left forward rotating augers, and located only at the more outer side than the width of the blower housing in the width direction. With this configuration, the snow collected at the center of the width direction of the auger housing is not pushed out in a direction away from the inlet of the blower housing by the right and left backward rotating augers. Thus, the snow crushed by the right and left backward rotating augers and the right and left forward rotating augers is efficiently pushed into the inlet of the blower housing, thereby achieving to remove the snow efficiently.

Additionally, the right and left forward rotating augers and the right and left backward rotating augers mutually rotate in the opposite directions. Therefore, upward reaction force generated at the right and left forward rotating augers at the time of snow removal is cancelled by downward reaction force generated at the right and left backward rotating augers. As a result, a lifting phenomenon of the right and left forward rotating augers can be suppressed, thereby achieving to improve stability of snow removal by the auger snow blower. Therefore, improvement can be achieved on both efficiency and stability of snow removal by the auger snow blower.

Preferably, the right and left forward rotating augers and the right and left backward rotating augers are connected to respective drive shafts configured to individually drive the respective augers by respective shear bolts. By thus individually providing the respective augers with the respective shear bolts, a load applied to the respective shear bolts can be distributed. Therefore, the respective shear bolts can be downsized and the shear bolt can be easily changed.

Additionally, the right and left forward rotating augers and the right and left backward rotating augers mutually rotate in the opposite directions. In the case where rotation of either forward rotating augers or backward rotating augers is nearly interrupted by some foreign object being stuck at one of the forward or backward rotating augers, such a stuck phenomenon of the foreign object can be easily resolved because the augers for the other rotation rotate in the reverse direction. Accordingly, frequency of changing the shear bolts can be reduced because occurrence of the stuck phenomenon of the foreign object is suppressed.

Preferably, a forward rotating shaft provided with the left or right forward rotating auger, a forward rotation drive shaft configured to drive the forward rotating shaft, a backward rotating shaft provided with the left or right backward rotating auger, and a backward rotation drive shaft configured to drive the backward rotating shaft are disposed on the same axis and positioned at a front portion of a machine body, the forward rotating shaft and the backward rotating shaft are adjacent in an axial direction thereof, the forward rotating shaft and the forward rotation drive shaft are respectively provided with irregular-shaped forward rotation flanges having protrusions protruding in a radial direction, the protrusions of the respective forward rotation flanges are mutually connected by a forward rotation shear bolt that can be fractured when subjected to a preset shearing force, the backward rotating shaft and the backward rotation drive shaft are respectively provided with irregular-shaped backward rotation flanges having protrusions protruding in a radial direction, the protrusions of the respective backward rotation flanges are mutually connected by a backward rotation shear bolt that can be fractured when subjected to a preset shearing force, and either the respective forward rotation flanges or the respective backward rotation flanges are positioned in the vicinity of the forward rotating shaft and the backward rotating shaft.

Thus, the protrusions of the respective forward rotation flanges are mutually connected by the forward rotation shear bolt. The drive force transmitted from a power source to the forward rotation drive shaft is transmitted to the forward rotating shaft via the forward rotation shear bolt. Further, the protrusions of the respective backward rotation flanges are mutually connected by the backward rotation shear bolt. The drive force transmitted from the power source to the backward rotation drive shaft is transmitted to the backward rotating shaft via the backward rotation shear bolt. In the case where any foreign object is stuck in at least one of the forward rotating augers and the backward rotating augers, the augers stuck with the foreign object can be protected by at least a part of the respective shear bolts being fractured.

Further, either the respective forward rotation flanges or the respective backward rotation flanges are positioned in the vicinity of the forward rotating shaft and the backward rotating shaft. Therefore, the protrusion positioned at a space between the forward rotating auger and the backward rotating auger rotate together with the forward rotating auger and the backward rotating auger. Further, even when the snow is accumulated in the space between the forward rotating auger and the backward rotating auger at the time of snow removal and causes the snow to adhere to the forward rotating shaft and the backward rotating shaft, the snow accumulated in the space can be crushed by rotation of the protrusion. Therefore, snow adhesion to the forward rotating shaft and the backward rotating shaft can be prevented. As a result, snow can be efficiently removed because snow is prevented from accumulating in the space. Moreover, the protrusion can be formed by the irregular-shaped flange configured to attach the shear bolt. Therefore, the number of components can be reduced because the protrusions do not have to be provided as separate members.

Preferably, the left and right backward rotating augers have an axial width smaller than an axial width of the left and right forward rotating augers. Therefore, the backward rotating auger acts weaker in throwing out the crushed snow to the upper front side. Since throwing out of the snow, namely, leak of snow can be thus reduced, efficiency of snow removal by the auger snow blower can be improved. Further, the lifting phenomenon of the forward rotating auger can be suppressed by the backward rotating auger. Furthermore, since the width in the axial direction of the backward rotating auger is small, the backward rotating auger acts weaker in throwing out the snow to upper front side. Therefore, resistance of the accumulated snow generated by rotation of the backward rotating auger can be reduced at the time of snow removal. Thus, improvement can be achieved on both efficiency and stability of snow removal by the auger snow blower.

BRIEF DESCRIPTION OF THE DRAWINGS

In the following, preferred embodiments of the present invention will be described in detail based on the attached drawings, in which.

DETAILED DESCRIPTION OF THE PREFERRED EMBODIMENTS

Certain preferred embodiments of the present invention will be described defining directions of "front", "rear", "left", "right", "up", and "down" in accordance with the directions viewed from an operator.

Figure 1:
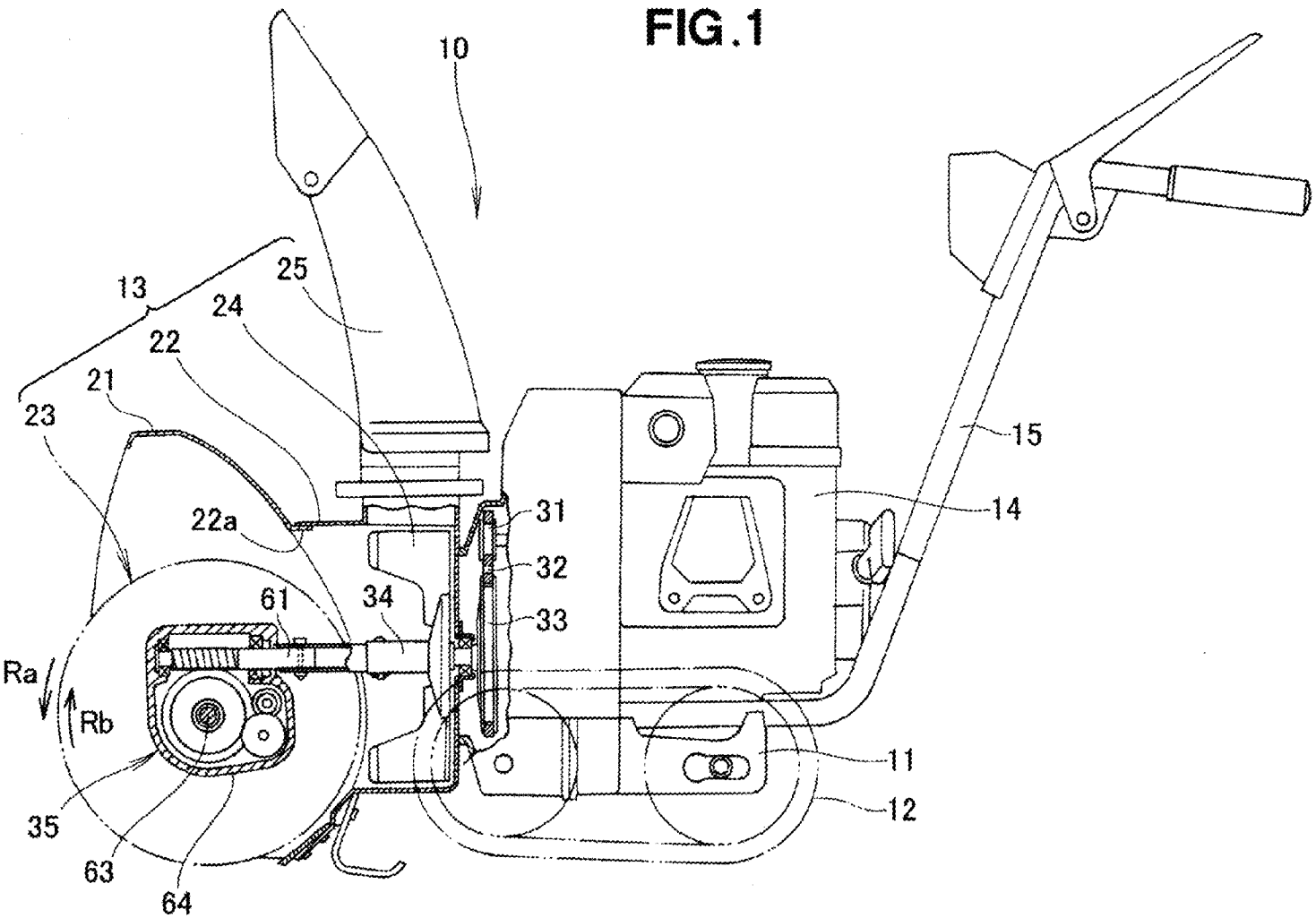
FIG. 1 is a side view of an auger snow blower according to a first embodiment of the present invention.

As shown in FIG. 1, an auger snow blower 10 is a self-propelled snow blower including a travel unit 12, a snow removing section 13, and a power source 14 at a machine body 11 (body frame 11). An operating handle 15 extends from a rear portion to an upper rear portion of the machine body 11. The operator can operate the auger snow blower 10 (hereinafter simply referred to as "snow blower 10") by the operating handle 15, walking along with the snow blower 10.

The snow removing section 13 includes an auger housing 21, a blower housing 22 disposed at a rear portion of the auger housing 21 and positioned at a center of a width direction of the auger housing 21, an auger 23 disposed inside the auger housing 21, a blower 24 disposed inside the blower housing 22, and a shooter 25 extending upward from the blower housing 22.

The power source 14 drives the travel unit 12 and the snow removing section 13 and includes, for example, an engine. Power of the power source 14 is transmitted to the blower 24 through a path passing a drive pulley 31, a driving belt 32, a driven pulley 33, and a transmission shaft 34, and also transmitted to the auger 23 from the transmission shaft 34 via a transmission 35. The snow collected by the auger 23 can be blown away by the blower 24 via the shooter 25. Note that the travel unit 12 may be also configured to be driven by an electric motor.

In the following, the snow removing section 13 will be described in detail. The blower housing 22 is a bottomed cylindrical member having an inlet 22*a* (opening 22*a*) on a back surface of the auger housing 21, and mounted on the machine body 11. The blower 24 is mounted on the transmission shaft 34 inside the blower housing 22. An input shaft 61 of the transmission 35 is connected to at a tip of the transmission shaft 34. The transmission 35 is positioned inside the auger housing 21.

Figure 2:
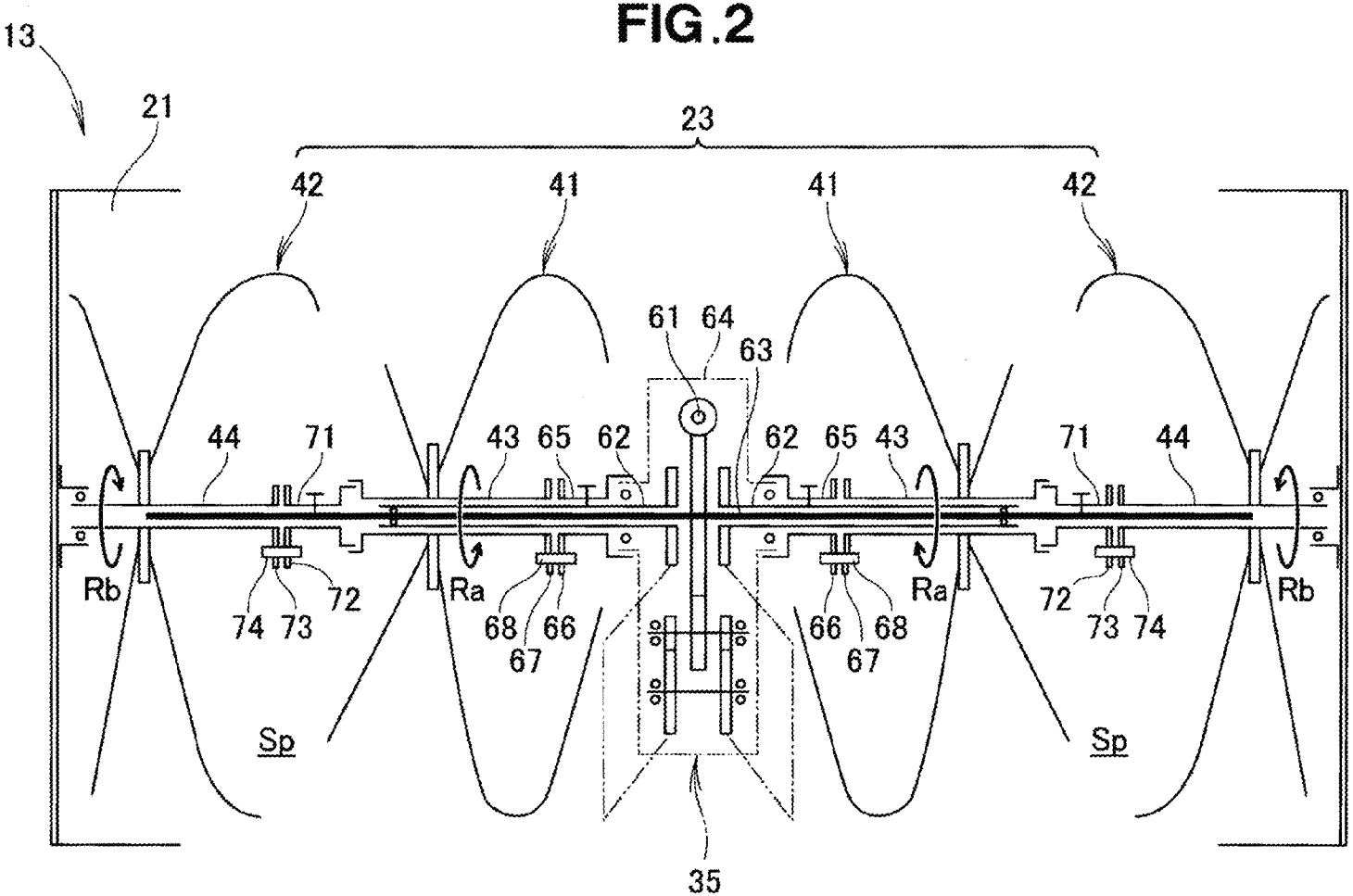
FIG. 2 is a schematic view diagrammatically illustrating an auger driving system viewed from a front side of the auger snow blower shown in FIG. 1.
Figure 3:
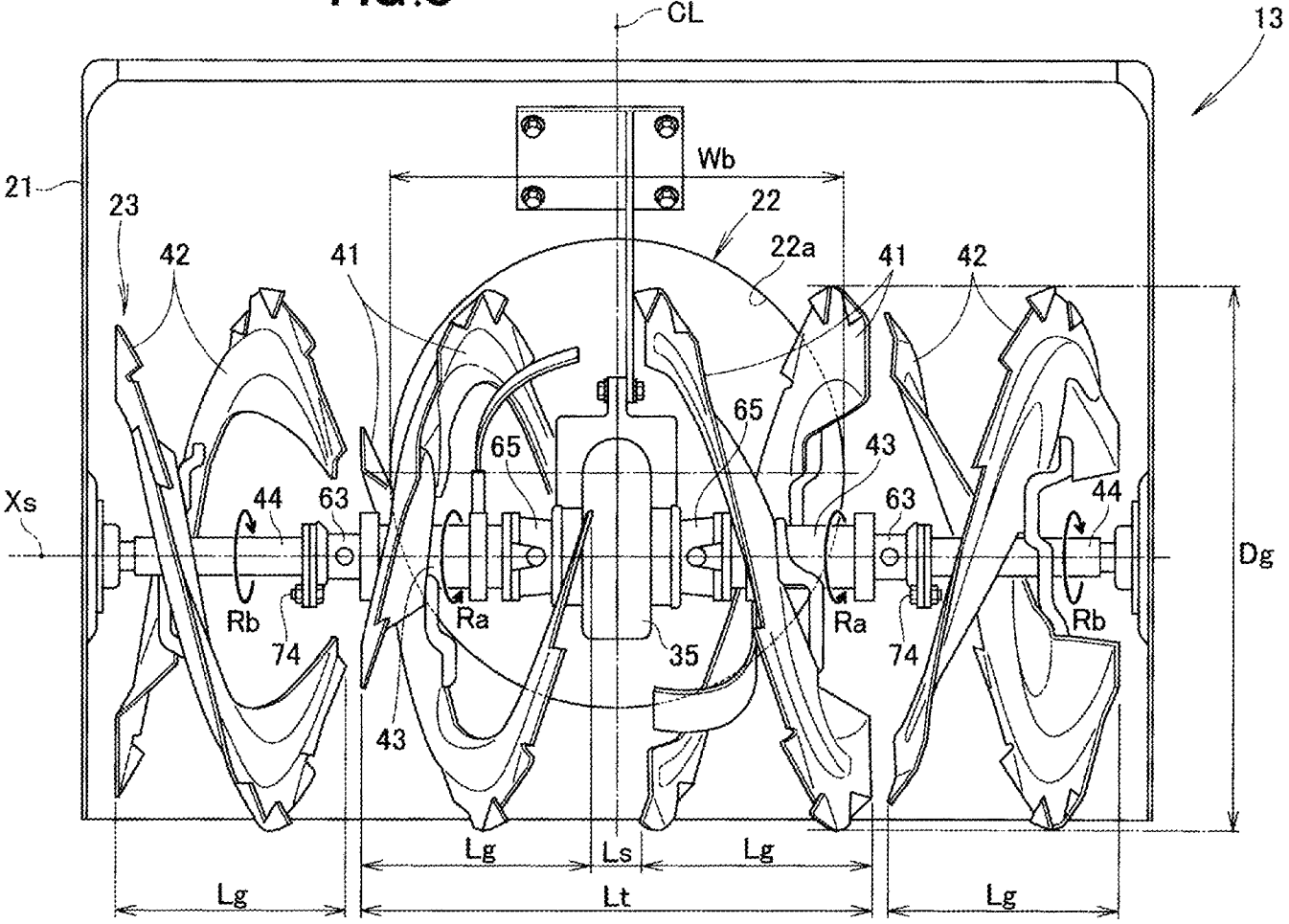
FIG. 3 is a front elevational view of an auger housing and an auger of the auger snow blower shown in FIG. 1.

As shown in FIGS. 2 and 3, the auger 23 includes right and left forward rotating augers 41, 41 that rotate from an upper side to a lower front side (in a direction indicated by an arrow Ra), and right and left backward rotating augers 42, 42 that rotate in a direction reverse to the right and left forward rotating augers 41, 41 (in a direction indicated by an arrow Rb) at the time of snow removal by the snow blower 10 (see FIG. 1). The left forward rotating auger 41 and the left backward rotating auger 42 are adjacent in an axial direction thereof. The right forward rotating auger 41 and the right backward rotating auger 42 are adjacent in the axial direction.

In the following, the rotary direction of the auger 23 when rotating from the upper side to the lower front side, namely, in the direction of the arrow Ra (anticlockwise direction in FIG. 1) at the time of snow removal by the snow blower 10 is referred to as "forward rotation". Further, the rotary direction of the auger when rotating in a direction reverse to the right and left forward rotating augers 41, 41, namely, in the direction of the arrow Rb (clockwise direction in FIG. 1) is referred to as "backward rotation".

The right and left forward rotating augers 41, 41 (forward rotating auger claws 41, 41) are belt-shaped members having a predetermined width, formed in a spiral, and disposed at right and left forward rotating shafts 43, 43. The right and left forward rotating augers 41, 41 are spiraled in a direction in which crushed snow is collected to the center of the width direction of the auger housing 21 (FIG. 1) by forward rotation of the right and left forward rotating augers 41, 41.

The right and left backward rotating augers 42, 42 (backward rotating auger claws 42, 42) are belt-shaped members having a predetermined width, formed in a spiral, and disposed at the right and left backward rotating shafts 44, 44. The right and left backward rotating augers 42, 42 are spiraled in a direction in which the crushed snow is collected to the center of the width direction of the auger housing 21 by backward rotation of the right and left backward rotating augers 42, 42.

The right and left forward rotating shafts 43, 43 and the right and left backward rotating shafts 44, 44 are disposed on the same axis (an axial line Xs shown in FIG. 3), and aligned in the width direction inside the auger housing 21. In other words, the right and left forward rotating shafts 43, 43 and the right and left backward rotating shafts 44, 44 are mutually disposed on the same axis and positioned at a front portion of the machine body 11 (see FIG. 1). The left forward rotating shaft 43 and the left backward rotating shaft 44 are adjacent in the axial direction. The right forward rotating shaft 43 and the right backward rotating shaft 44 are adjacent in the axial direction thereof.

The transmission 35 includes right and left forward rotation drive shafts 62, 62 and a single backward rotation drive shaft 63.

The right and left forward rotation drive shafts 62, 62 are mutually positioned on the same axis and extend in the width direction of the auger housing 21. The right and left forward rotation drive shafts 62, 62 are formed of pipe shafts rotatably supported at a case 64 of the transmission 35, and can rotate only in the forward rotating direction Ra by inputting drive force to the input shaft 61. In other words, the rotary direction Ra of the right and left forward rotation drive shafts 62, 62 is a direction in which the right and left forward rotating augers 41, 41 are made to rotate forward.

The backward rotation drive shaft 63 extends in the width direction of the auger housing 21, and is fitted to the right and left forward rotation drive shafts 62, 62 in a relatively rotatable manner, and further projected more outside than the right and left forward rotation drive shafts 62, 62 in the axial direction. The backward rotation drive shaft 63 can rotate only in the backward rotary direction Rb by inputting drive force to the input shaft 61. In other words, the rotary direction Rb of the backward rotation drive shaft 63 is a direction in which the right and left backward rotating augers 42, 42 are made to rotate backward.

The right and left forward rotation drive shafts 62, 62 are fitted with right and left forward rotation rotary shafts 65, 65 positioned close to the case 64 and the right and left forward rotating shafts 43, 43 positioned distant from the case 64. In other words, the right and left forward rotation rotary shafts 65, 65 and the right and left forward rotating shafts 43, 43 are formed of pipe shafts (pipe-shaped shafts). More specifically, the right and left forward rotation rotary shafts 65, 65 are connected in a manner whereby both relative axial movement and relative rotation are restricted with respect to the right and left forward rotation drive shafts 62, 62. The right and left forward rotating shafts 43, 43 are adjacent to the right and left forward rotation rotary shafts 65, 65 on an outer side in the axial direction, and relatively rotatable to the right and left forward rotation drive shafts 62, 62. The right forward rotation rotary shaft 65 and the right forward rotating shaft 43 respectively include right forward rotation flanges 66, 67.

As illustrated in FIG. 3, the blower housing 22 is disposed at the center of the width direction of the auger housing 21, namely, at a width center CL. The right and left forward rotating augers 41, 41 and the right and left backward rotating augers 42, 42 all have the same outside diameter Dg. The right and left forward rotating augers 41, 41 and the right and left backward rotating augers 42, 42 all have the same width Lg. The right and left forward rotating augers 41, 41 and the right and left backward rotating augers 42, 42 all have the same rotational rate.

The blower housing 22 is formed in a cylindrical shape and has a true circle shape in the front elevational view. Accordingly, the inlet 22*a* of the blower housing 22 also has the true circle in the front elevational view. In the front elevational view of the auger housing 21, a width Wb of the blower housing 22 is identical to a radius of the inlet 22*a*.

The right and left forward rotating augers 41, 41 are positioned symmetrically to the width center CL of the auger housing 21 in the width direction, and also positioned distant from each other by a distance Ls in the width direction. The distance Ls is determined in consideration of snow removing property of the right and left forward rotating augers 41, 41.

The right and left forward rotating augers 41, 41 are positioned at least in an entire range of the width Wb of the blower housing 22 (range along the width direction of the auger housing 21). In other words, in the front elevational view of the auger housing 21, a total length Lt from a left end of the left forward rotating auger 41 to a right end of the right forward rotating auger 41 is equal to or larger than the width Wb of the blower housing 22. The total length Lt is calculated by adding the distance Ls between the right and left forward rotating augers 41, 41 to the respective widths Lg, Lg of the right and left forward rotating augers 41, 41 (Lt=Lg+Lg+Ls).

The right and left backward rotating augers 42, 42 are positioned symmetrically to the width center CL of the auger housing 21 in the width direction. In other words, the right and left backward rotating augers 42, 42 are separately positioned on the both sides of the right and left forward rotating augers 41, 41, and also positioned only at the more outer side than the width Wb of the blower housing 22 in the width direction.

The following is a summary of the above description. The snow crushed by the right and left backward rotating augers 42, 42 and the right and left forward rotating augers 41, 41 is collected at the center of the width direction of the auger housing 21 by the right and left forward rotating augers 41, 41, and further sent to the inlet 22*a* of the blower housing 22 on the rear side.

The right and left forward rotating augers 41, 41 are positioned at least in the entire range of the width Wb of the blower housing 22. Therefore, the snow collected at the center of the width direction of the auger housing 21 can be efficiently pushed into the inlet 22*a* of the blower housing 22 by the right and left forward rotating augers 41, 41 that rotate from the upper side to the lower front side (forward rotation).

On the other hand, the right and left backward rotating augers 42, 42 rotate from the upper side to the lower back side (backward), thereby sending the crushed snow to the front side. Here, the right and left backward rotating augers 42, 42 are separately positioned on the both sides of the right and left forward rotating augers 41, 41, and also positioned only at the more outer side than the width Wb of the blower housing 22 in the width direction. Therefore, the snow collected at the center of the width direction of the auger housing 21 is prevented from being pushed out in a direction away from the inlet 22*a* of the blower housing 22 by the right and left backward rotating augers 42, 42.

Thus, the snow crushed by the right and left backward rotating augers 42, 42 and the right and left forward rotating augers 41, 41 can be efficiently pushed into the inlet 22*a* of the blower housing 22, and the snow can be efficiently removed.

Also, the right and left forward rotating augers 41, 41 and the right and left backward rotating augers 42, 42 mutually rotate in the opposite directions. Accordingly, an upward reaction force generated at the right and left forward rotating augers 41, 41 can be cancelled by a downward reaction force generated at the right and left backward rotating augers 42, 42 at the time of snow removal. As a result, a lifting phenomenon of the right and left forward rotating augers 41, 41 can be suppressed, thereby achieving to improve stability of the snow removal by the snow blower 10.

Additionally, in some locations of the accumulated snow, snow quality is hard like a frozen state. In the case of removing such hard accumulated snow, the lifting phenomenon is likely to occur at the right and left backward rotating augers 42, 42 because the upward reaction force generated at the right and left backward rotating augers 42, 42 is large when snow removal is executed simply by traveling the snow blower 10 in a straight line. As a result, the snow blower 10 moves unstably in the width direction, thereby bringing disadvantages to improving straight traveling ability.

To solve such a situation, one-side operation whereby only a left half or a right half of the auger 23 is operated for the accumulated snow is often executed in order to remove the accumulated hard snow while suppressing the lifting phenomenon of the right and left backward rotating augers 42, 42. In other words, by executing the one-side operation, the accumulated snow can be sequentially chipped off from one end to the other end by the auger 23.

According to the first embodiment discussed above, the lifting phenomenon of the entire auger 23 by the reaction force can be suppressed because the right and left backward rotating augers 42, 42 are positioned at the more outer side than the right and left forward rotating augers 41, 41 in the width direction. Therefore, straight traveling ability of the snow blower 10 can be improved at the time of snow removal, thereby improving stability of the snow removal.

Thus, according to the first embodiment, improvement can be achieved on both efficiency and stability of snow removal by the auger snow blower 10.

Figure 4:
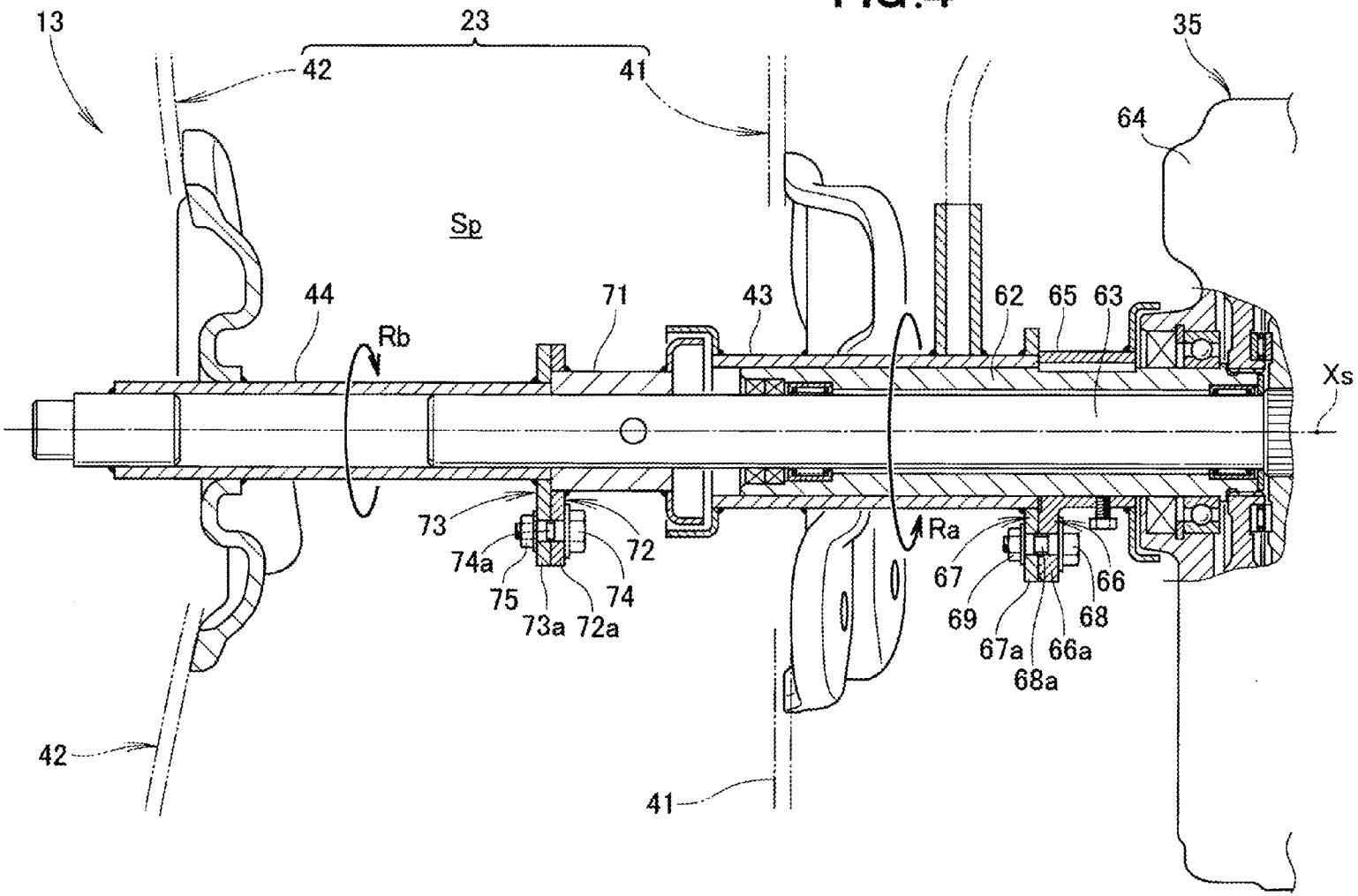
FIG. 4 is a front elevational view showing a substantially right half of a transmission illustrated in FIG. 2.

As illustrated in FIGS. 2 and 4, the right and left forward rotating augers 41, 41 and the right and left backward rotating augers 42, 42 are connected, by respective shear bolts 68, 68, 74, 74, to the respective drive shafts 62, 63 for respective rotations configured to individually drive the respective augers 41, 41, 42, 42.

By individually providing the respective shear bolts 68, 68, 74, 74, a load applied to the respective shear bolts 68, 68, 74, 74 can be distributed. As a result, the respective shear bolts 68, 68, 74, 74 can be downsized and the shear bolts 68, 68, 74, 74 can be easily changed.

Further, the right and left forward rotating augers 41, 41 and the right and left backward rotating augers 42, 42 mutually rotate in the opposite directions. In the case where one of forward or backward rotations, for example, rotation of the forward rotating augers 41, 41 is nearly interrupted by some foreign object stuck at the forward rotating augers 41, 41, the stuck phenomenon of the foreign object can be easily resolved because the other augers 42, 42 rotate in the reverse direction. Therefore, frequency of changing the shear bolts 68, 68, 74, 74 can be reduced by preventing the stuck phenomenon of the foreign object from occurring.

Figure 5:
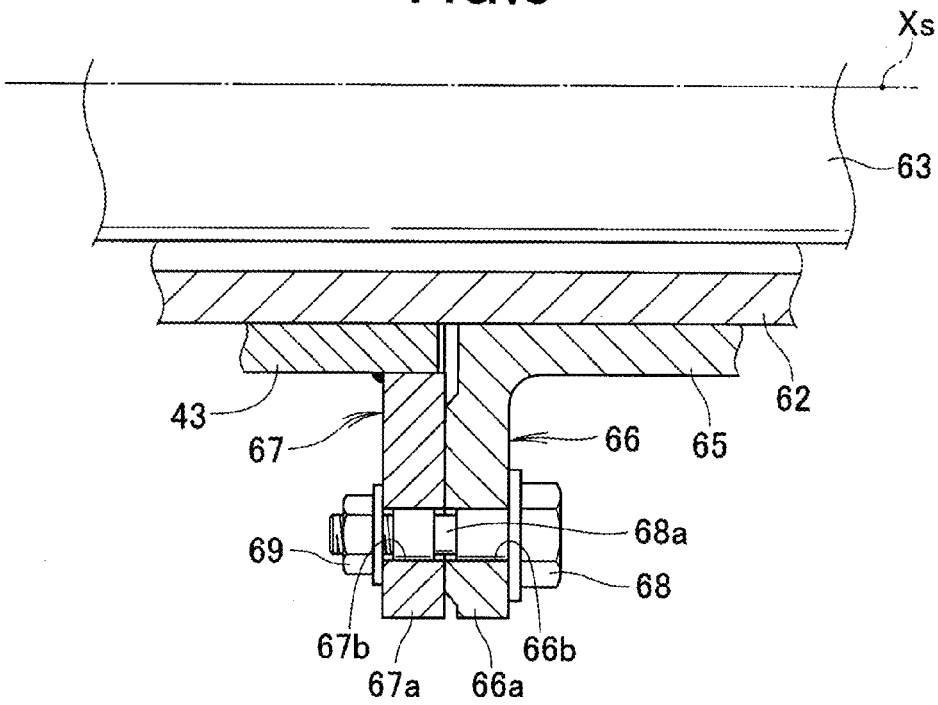
FIG. 5 is a cross-sectional view of a joining portion of respective forward rotation flanges shown in FIG. 4.

As illustrated in FIGS. 4 and 5, the respective right forward rotation flanges 66, 67 are positioned on side surfaces facing each other in the axial direction of the right forward rotation rotary shaft 65 and the right forward rotating shaft 43, and also superimposed each other in the axial direction. The respective right forward rotation flanges 66, 67 are basically shaped like a disc. More specifically, the respective right forward rotation flanges 66, 67 are so-called irregular-shaped flanges that include protrusions 66*a*, 67*a* partly protruding from an outer peripheral surface of the circular disc.

Figure 6:
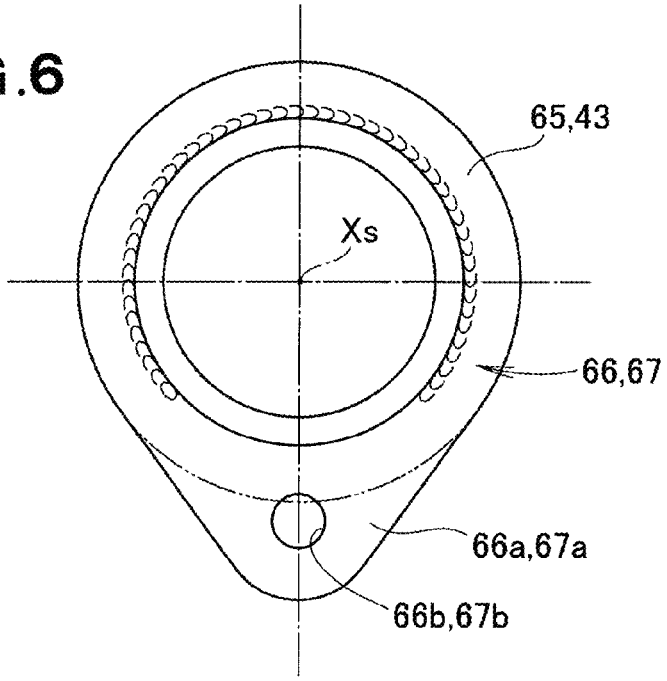
FIG. 6 is a view showing the forward rotation flange to which a shear bolt shown in FIG. 5 is attached, viewed from an outer side in an axial direction of the forward rotating shaft.

The protrusions 66*a*, 67*a* of the respective right forward rotation flanges 66, 67 are mutually connected by one shear bolt 68. The forward rotation shear bolt 68 is a member that can be fractured when subjected to a preset shearing force. More specifically, the forward rotation shear bolt 68 is a member inserted through the respective through-holes 66*b*, 67*b* formed at the respective protrusions 66*a*, 67*a* (see FIGS. 5 and 6), and configured to fasten the respective protrusions 66*a*, 67*a* each other with a nut 69 screwed.

The forward rotation shear bolt 68 partly includes a small-diameter portion 68*a*. The small-diameter portion 68*a* is positioned at a mating face of the protrusions 66*a*, 67*a* inside the forward rotation shear bolt 68, and has a diameter smaller than other parts of the shear bolt 68. The small-diameter portion 68*a* is fractured to cut connection between the respective protrusions 66*a*, 67*a* in the case where shearing force applied to the small-diameter portion 68*a* reaches the preset reference shearing force.

As illustrated in FIG. 2, the left forward rotation rotary shaft 65 and the left forward rotating shaft 43 also include left forward rotation flanges 66, 67. The respective left forward rotation flanges 66, 67 have the same configuration as the above-described respective right forward rotation flanges 66, 67, and connected by the forward rotation shear bolt 68.

Note that the right and left forward rotation rotary shafts 65, 65 can be eliminated, and the right and left forward rotation flanges 66, 66 can be directly provided at the right and left forward rotation drive shafts 62, 62. In other words, the right and left forward rotation flanges 66, 66 may be either directly or indirectly provided at the right and left forward rotation drive shafts 62, 62.

As illustrated in FIGS. 2 and 3, the right and left backward rotation drive shafts 71, 71 adjacent to the right and left forward rotating shafts 43, 43 and the right and left backward rotating shafts 44, 44 distant from the right and left forward rotating shafts 43, 43 are fitted to the both axial ends of the backward rotation drive shaft 63. In other words, the right and left backward rotation rotary shafts 71, 71 and the right and left backward rotating shafts 44, 44 are formed of pipe shafts (pipe-shaped shafts). More specifically, the right and left backward rotation rotary shafts 71, 71 are connected and in a manner whereby both relative axial movement and relative rotation is restricted with respect to the backward rotation drive shaft 63. The right and left backward rotating shafts 44, 44 are adjacent to the right and left backward rotation rotary shafts 71, 71 on the outer side in the axial direction, and are relatively movable to the backward rotation drive shaft 63.

The right backward rotation rotary shaft 71 and the right backward rotating shaft 44 respectively include the right backward rotation flanges 72, 73. The respective right backward rotation flanges 72, 73 are positioned on side surfaces facing each other in the axial direction of the right backward rotating shaft 44 and the right backward rotation rotary shaft 71, and further mutually superimposed in the axial direction. The respective right backward rotation flanges 72, 73 substantially (basically) have the same configuration as the right and left forward rotation flanges 66, 67. More specifically, the respective right backward rotation flanges 72, 73 are basically shaped like a circular disc. More specifically, the respective right backward rotation flanges 72, 73 are so-called irregular-shaped flanges that include protrusions 72*a*, 73*a* partly protruding from an outer peripheral surface formed in a true circle (see FIG. 4).

As illustrated in FIG. 4, the protrusions 72*a*, 73*a* of the respective right backward rotation flanges 72, 73 are mutually connected by one backward rotation shear bolt 74. The backward rotation shear bolt 74 substantially (basically) has the same configuration as the above-described forward rotation shear bolt 68, and fastens the receptive protrusions 72*a*, 73*a* each other with the nut 75 screwed.

More specifically, the backward rotation shear bolt 74 is a member that can be fractured when subjected to a preset shearing force. In other words, the backward rotation shear bolt 74 partly includes a small-diameter portion 74*a*. The small-diameter portion 74*a* is positioned at a mating face of the protrusions 72*a*, 73*a* inside the backward rotation shear bolt 74, and has a diameter smaller than other parts of the shear bolt 74. The small-diameter portion 74*a* is fractured and cuts connection between the respective protrusions 72*a*, 73*a* in the case where shearing force applied to the small-diameter portion 74*a* reaches the preset reference shearing force.

As illustrated in FIG. 2, the left backward rotating shaft 44 and the left backward rotation rotary shaft 71 also respectively include the left backward rotation flanges 72, 73. The respective left backward rotation flanges 72, 73 have the same configuration as the above-described right backward rotation flanges 72, 73, and connected by the backward rotation shear bolt 74.

Note that the right and left backward rotation rotary shafts 71, 71 may be eliminated and the right and left backward rotation flanges 72, 72 can be directly provided at the backward rotation drive shaft 63. In other words, the right and left backward rotation flanges 72, 72 may be either directly or indirectly provided at the backward rotation drive shaft 63.

As illustrated in FIGS. 2 and 4, either the respective right forward rotation flanges 66, 67 or the respective right backward rotation flanges 72, 73 are positioned in the vicinity of the right forward rotating shaft 43 and the right backward rotating shaft 44. Either the respective left forward rotation flanges 66, 67 or the respective left backward rotation flanges 72, 73 are also positioned in the vicinity of the left forward rotating shaft 43 and the left backward rotating shaft 44.

The following is a summary of the above description. Note that only a right half of the auger 23 will be described and description for a left half will be omitted because the configuration is same as the right half.

The protrusions 66*a*, 67*a* of the forward rotation flanges 66, 67 are mutually connected by the forward rotation shear bolt 68. The drive force transmitted from the power source 14 (see FIG. 1) to the forward rotation drive shafts 62 is transmitted to the forward rotating shaft 43 via the forward rotation shear bolt 68. Further, the protrusions 72*a*, 73*a* of the respective backward rotation flanges 72, 73 are mutually connected by the backward rotation shear bolt 74. The drive force transmitted from the power source 14 to the backward rotation drive shaft 63 is transmitted to the backward rotating shaft 44 via the backward rotation shear bolt 74. In the case where a foreign object is stuck in at least one of the forward rotating auger 41 and the backward rotating auger 42, the augers 41, 42 stuck with the foreign object can be protected by at least a part of the respective shear bolts 68, 74 being fractured.

Furthermore, either the respective forward rotation flanges 66, 67 or respective backward rotation flanges 72, 73 are positioned in the vicinity of the forward rotating shaft 43 and the backward rotating shaft 44. Therefore, the protrusions 72*a*, 73*a* positioned in a space Sp between the forward rotating auger 41 and the backward rotating auger 42 rotate together with the forward rotating auger 41 and the backward rotating auger 42. Even in the case where the snow is accumulated in the space between the forward rotating auger 41 and the backward rotating auger 42 and causes the snow to adhere to the forward rotating shaft 43 and the backward rotating shaft 44 at the time of snow removal, the accumulated snow in the space Sp can be crushed by rotation of the protrusions 72*a*, 73*a*. Therefore, adhesion of the snow to the forward rotating shaft 43 and the backward rotating shaft 44 can be prevented. As a result, the snow can be efficiently removed because snow is not accumulated in the space Sp. Additionally, the protrusions 72*a*, 73*a* may be formed of the irregular-shaped flanges 72, 73 configured to attach the shear bolt 74. Therefore, the number of components can be reduced because the protrusions do not have to be provided as separate members.

Figure 7:
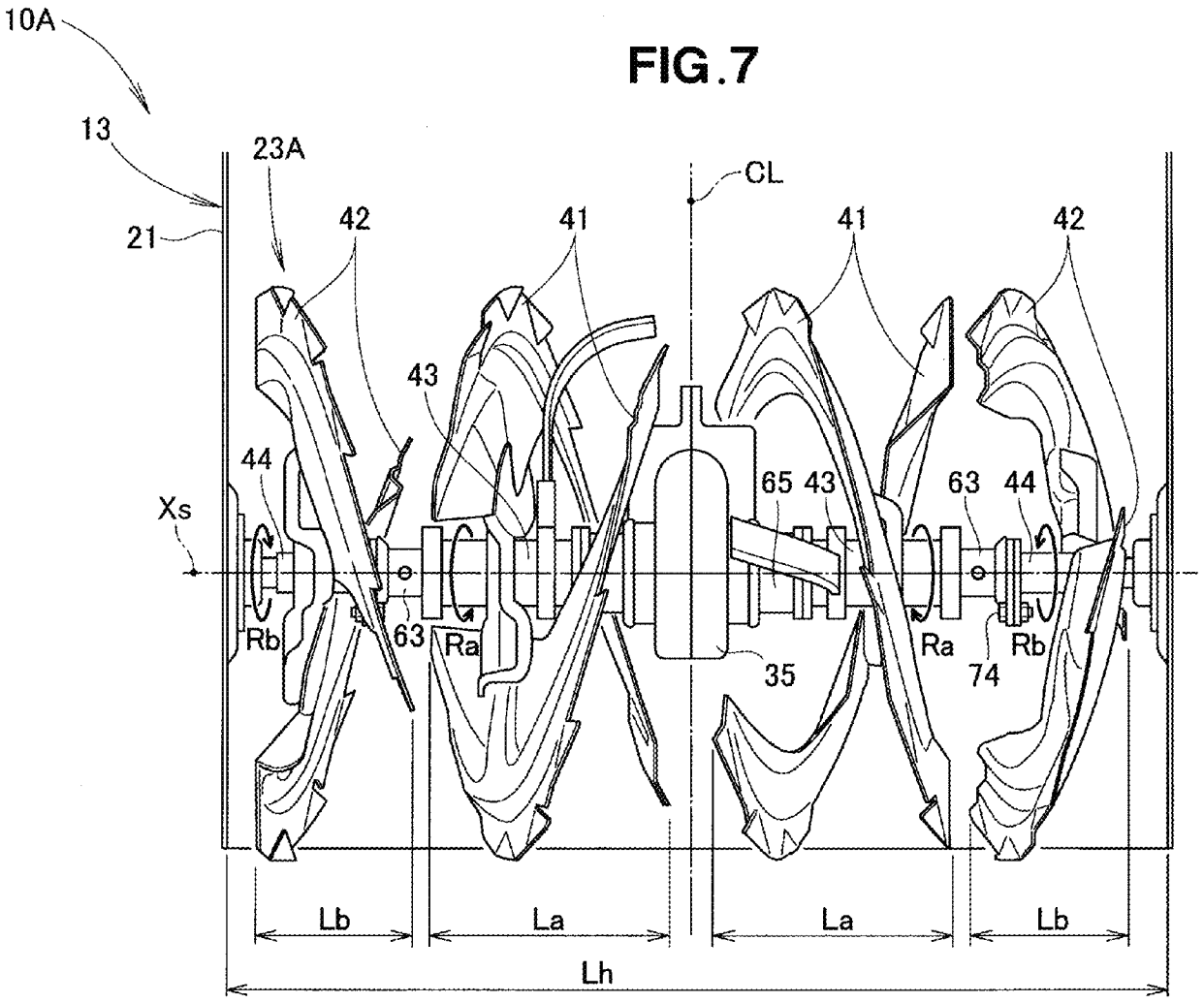
FIG. 7 is a front elevational view of an auger housing and an auger of an auger snow blower according to a second embodiment of the present invention.

Next, an auger snow blower 10A according to a second embodiment will be described based on FIG. 7.

A basic configuration of an auger 23A of the auger snow blower 10A according to the second embodiment is same as an auger 23 of an auger snow blower 10 according of the first embodiment. The auger 23A according to the second embodiment is illustrated having a phase different from the auger 23 according to the first embodiment.

Right and left forward rotating augers 41, 41 are positioned close to a center of a width direction of an auger housing 21, and adjacent each other interposing a transmission 35 positioned at a width center CL. In other words, the right and left forward rotating augers 41, 41 are positioned at least in an entire range of a width Wb of a blower housing 22 (see FIG. 3).

Right and left backward rotating augers 42, 42 are positioned on both sides of the auger housing 21 in the width direction, more specifically, positioned at a more outer side than the width Wb of the blower housing 22 in the width direction (see FIG. 3). In other words, the right and left backward rotating augers 42, 42 are positioned at the more outer side than the right and left forward rotating augers 41, 41 in the width direction of the auger housing 21. The left forward rotating auger 41 and the left backward rotating auger 42 are adjacent in an axial direction thereof. The right forward rotating auger 41 and the right backward rotating auger 42 are adjacent in the axial direction thereof.

The right and left forward rotating augers 41, 41 and the right and left backward rotating augers 42, 42 all have the same outside diameter. The right and left forward rotating augers 41, 41 have a width La in the axial direction (width of the auger housing 21 in the width direction). The width La is set same as a width Lg in the axial direction of the right and left forward rotating augers 41, 41 according to the first embodiment illustrated in FIG. 3 (La=Lg). The right and left backward rotating augers 42, 42 have a width Lb in the axial direction (width of the auger housing 21 in the width direction). The width Lb in the axial direction of the right and left backward rotating augers 42, 42 is smaller than the width La in the axial direction of the right and left forward rotating augers 41, 41 (Lb<La). The right and left forward rotating augers 41, 41 and the right and left backward rotating augers 42, 42 all have the same rotational rate.

Snow crushed by the right and left backward rotating augers 42, 42 is collected to the right and left forward rotating augers 41, 41. The collected snow and the snow crushed by the right and left forward rotating augers 41, 41 are collected at the center of the width direction of the auger housing 21 by the right and left forward rotating augers 41, 41, and further sent to the blower housing 22 on the rear side (see FIG. 1). The snow sent to the blower housing 22 is blown away by a blower 24 illustrated in FIG. 1 via a shooter 25.

The following is a summary of the above description. The right and left forward rotating augers 41, 41 that rotate from an upper side to a lower front side and the right and left backward rotating augers 42, 42 that rotate in a direction reverse to the right and left forward rotating augers 41, 41 when the snow blower 10A removes snow are positioned on the same axis and aligned in the width direction inside the auger housing 21, and also positioned at a front portion of a machine body 11.

The width Lb in the axial direction of the right and left backward rotating augers 42, 42 is smaller than the width La in the axial direction of the right and left forward rotating augers 41, 41. Due to that, the right and left backward rotating augers 42, 42 act weaker in throwing out the crushed snow to the upper front side. Since throwing out of the snow, namely, leak of snow can be reduced, efficiency of snow removal by the snow blower 10A can be improved. Particularly, this is effective in the case where a width Lh of the auger housing 21 is small.

Additionally, the right and left forward rotating augers 41, 41 and the right and left backward rotating augers 42, 42 mutually rotate in the opposite directions. Therefore, an upward reaction force generated at the right and left forward rotating augers 41, 41 can be cancelled by a downward reaction force generated at the right and left backward rotating augers 42, 42 at the time of snow removal. As a result, a lifting phenomenon of the right and left forward rotating augers 41, 41 can be suppressed, thereby achieving to improve stability of the snow removal by the snow blower 10A.

Furthermore, since the width Lb in the axial direction of the right and left backward rotating augers 42, 42 is smaller than the width La in the axial direction of the right and left forward rotating augers 41, 41, the backward rotating augers act weaker in throwing out snow to an upper front side. Therefore, resistance of the accumulated snow generated by rotation of the backward rotating augers 42, 42 can be reduced at the time of snow removal.

Thus, according to the second embodiment, improvement can be achieved on both efficiency and stability of snow removal by the auger snow blower 10A.

Figure 8:
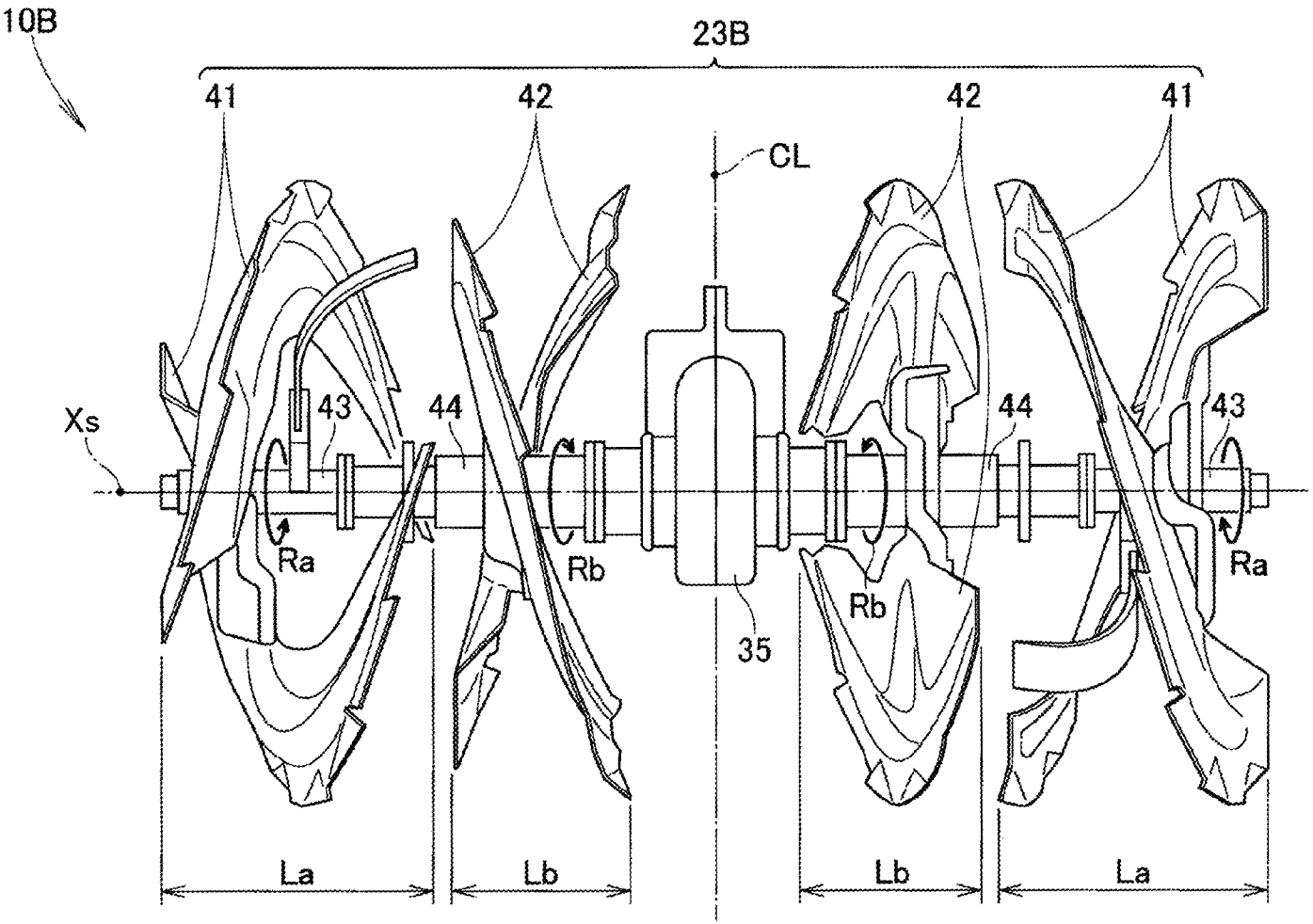
FIG. 8 is a front elevational view of an auger according to a third embodiment of the present invention.

Next, an auger snow blower 10B according to a third embodiment will be described with reference to FIG. 8.

A basic configuration of an auger 23B according to the third embodiment is same as an auger 23A according to the second embodiment, but arrangement of right and left forward rotating augers 41, 41 and right and left backward rotating augers 42, 42 is changed. The auger 23B according to the third embodiment is illustrated having a phase different from the auger 23A according to the second embodiment.

More specifically, the right and left backward rotating augers 42, 42 are positioned close to a center of a width direction of an auger housing 21 (see FIG. 7), and adjacent each other interposing a transmission 35 positioned at a width center CL. The right and left forward rotating augers 41, 41 are positioned on both sides of the auger housing 21 in the width direction. In other words, the right and left forward rotating augers 41, 41 are positioned at a more outer side than the right and left backward rotating augers 42, 42 in the width direction of the auger housing 21. According to the third embodiment, a rotary direction of a transmission 35 illustrated in FIG. 7 is to be set opposite. Note that, according to the third embodiment, at least a part of the right and left backward rotating augers 42, 42 is positioned within a width of the blower housing 22 (see FIG. 1).

As described above, the auger snow blowers 10, 10A, and 10B according to the present invention are suitable for a snow blower in which an auger 23 is driven by a power source 14.

Obviously, various minor changes and modifications of the present invention are possible in light of the above teaching. It is therefore to be understood that within the scope of the appended claims the invention may be practiced otherwise than as specifically described.

What is claimed is:

1. An auger snow blower comprising:

an auger housing;

right and left forward rotating augers configured to rotate from an upper side to a lower front side;

right and left backward rotating augers configured to rotate in a direction reverse to the right and left forward rotating augers at the time of snow removal;

the right and left forward rotating augers and the right and left backward rotating augers being disposed on a same axis and aligned in a width direction inside the auger housing;

a blower housing disposed at a rear portion of the auger housing and positioned at a center of the width direction of the auger housing; and a blower disposed inside the blower housing, wherein the right and left forward rotating augers are positioned in an entire range of a width of the blower housing, the right and left backward rotating augers are separately positioned on both sides of the right and left forward rotating augers, and also positioned only at a more outer side than the width of the blower housing in the width direction, each of the right and left forward rotating augers includes a forward rotating shaft provided with the left or right forward rotating auger, and a forward rotation drive shaft configured to drive the forward rotating shaft, each of the right and left backward rotating augers includes a backward rotating shaft provided with the left or right backward rotating auger, and a backward rotation drive shaft configured to drive the backward rotating shaft, the forward rotating shaft, the forward rotation drive shaft, the backward rotating shaft and the backward rotation drive shaft are disposed on the same axis and positioned at a front portion of a machine body, the forward rotating shaft and the backward rotating shaft are adjacent in an axial direction thereof, the forward rotating shaft and the forward rotation drive shaft are respectively provided with irregular-shaped forward rotation flanges having protrusions protruding in a radial direction, the protrusions of the respective forward rotation flanges are mutually connected by a forward rotation shear bolt that can be fractured when subjected to a preset shearing force, the backward rotating shaft and the backward rotation drive shaft are respectively provided with irregular-shaped backward rotation flanges having protrusions protruding in a radial direction, the protrusions of the respective backward rotation flanges are mutually connected by a backward rotation shear bolt that can be fractured when subjected to a preset shearing force, the protrusions of the respective forward rotation flanges are disposed in a space defined between the left or right forward rotation auger and a transmission disposed between the left and right forward rotation augers, the protrusions being rotatable with the left or right forward rotation auger to thereby prevent snow from adhering to the forward rotating shaft, and the protrusions of the respective backward rotation flanges are disposed in a space defined between the left or right backward rotation auger and an adjacent one of the left and right forward rotation augers, the protrusions being rotatable with the left or right backward rotation auger to thereby prevent snow from adhering to the backward rotating shaft.

2. The auger snow blower according to claim 1, wherein the left and right backward rotating auger have an axial width smaller than an axial width of the left and right forward rotating augers.

3. The auger snow blower according to claim 1, wherein each of the forward rotation shear bolt and the backward rotation shear bolt has a small-diameter portion positioned at a mating face of the protrusions of the forward or backward rotation flanges and having a diameter smaller than other part of the forward or backward rotation hear bolt.

* * * * *